US009454951B2

(12) United States Patent
Hsieh et al.

(10) Patent No.: US 9,454,951 B2
(45) Date of Patent: Sep. 27, 2016

(54) ELECTRONIC DEVICE

(71) Applicant: Acer Incorporated, New Taipei (TW)

(72) Inventors: Cheng-Wen Hsieh, New Taipei (TW); Wen-Neng Liao, New Taipei (TW)

(73) Assignee: Acer Incorporated, New Taipei (TW)

( * ) Notice: Subject to any disclaimer, the term of this patent is extended or adjusted under 35 U.S.C. 154(b) by 44 days.

(21) Appl. No.: 14/555,575

(22) Filed: Nov. 27, 2014

(65) Prior Publication Data

US 2016/0078858 A1 Mar. 17, 2016

(30) Foreign Application Priority Data

Sep. 16, 2014 (TW) ..... 103131897 A

(51) Int. Cl.

| | |
|---|---|
| ***H04R 3/02*** | (2006.01) |
| ***G10K 11/172*** | (2006.01) |
| ***G10K 11/178*** | (2006.01) |
| ***H04R 27/00*** | (2006.01) |

(52) U.S. Cl.

CPC ..... *G10K 11/172* (2013.01); *G10K 11/1788* (2013.01); *H04R 3/02* (2013.01); *H04R 27/00* (2013.01)

(58) Field of Classification Search

None

See application file for complete search history.

(56) References Cited

U.S. PATENT DOCUMENTS

| | | | | |
|---|---|---|---|---|
| 5,792,999 | A * | 8/1998 | Arnold | H04R 1/2842 181/141 |
| 2013/0021738 | A1* | 1/2013 | Yang | G06F 1/1632 361/679.27 |

FOREIGN PATENT DOCUMENTS

| | | |
|---|---|---|
| CN | 201097388 | 8/2008 |
| CN | 201622837 | 11/2010 |
| CN | 203673822 | 6/2014 |

* cited by examiner

*Primary Examiner* — Muhammad N Edun

(74) *Attorney, Agent, or Firm* — Jianq Chyun IP Office

(57) ABSTRACT

An electronic device is provided. The electronic device includes a casing, a resonance cover, and a plurality of electronic components. The resonance cover covers a part of the casing so as to define a resonance chamber with the casing. The resonance chamber includes a plurality of openings. The electronic components are disposed in the casing and adapted to generate a plurality of audio frequencies, wherein a diameter of each of the openings is related to the corresponding audio frequency generated by the corresponding electronic component.

9 Claims, 2 Drawing Sheets

ELECTRONIC DEVICE

CROSS-REFERENCE TO RELATED APPLICATION

This application claims the priority benefit of Taiwan application serial no. 103131897, filed on Sep. 16, 2014. The entirety of the above-mentioned patent application is hereby incorporated by reference herein and made a part of this specification.

BACKGROUND OF THE INVENTION

1. Field of the Invention

The invention relates to an electronic device, and more particularly, to an electronic device capable of reducing noise generated by an electronic component therein.

2. Description of Related Art

In recent years, with the rapid advances in computer technology, the operating speed of computers is constantly increasing. Since the number of personal computers in the workplace and home is increasing rapidly, related issues are generated in the computing environment. One of the concerns is the generation of noise when a computer is in operation.

For instance, electronic components such as fans, hard disks, and power supplies in the computer all generate noise during the operating process. Specifically, to prevent overheating of electronic components in the host computer and the resulting temporary or permanent failure of the electronic components, a fan is typically disposed on electronic components for which temperature is readily increased, such as a power supply, a CPU, and a GPU of the host computer, so as to perform cooling on the electronic components to rapidly remove heat energy generated by the electronic components at high-speed operation. As a result, temperature of the electronic components themselves is reduced, such that the operation of the host computer can be better.

However, the rotation of the fan generates a vibrating noise. Moreover, when the hard disk is rotating at high speed, a large amount of noise is also generated. Accordingly, when the vibrating noise is within the receiving range of the human ear, the auditory experience of the user is affected, and the operating comfort of the user is also affected.

SUMMARY OF THE INVENTION

The invention provides an electronic device capable of reducing noise generated by an electronic component therein.

An electronic device of the invention includes a casing, a resonance cover, and a plurality of electronic components. The resonance cover covers at least a part of the casing so as to define a resonance chamber with the casing. The resonance chamber includes a plurality of openings. The electronic components are disposed in the casing and adapted to generate a plurality of audio frequencies, wherein a diameter of each of the openings is related to the corresponding audio frequency generated by the corresponding electronic component.

Based on the above, in the invention, a resonance cover is disposed on the casing such that the resonance cover and the casing define a resonance chamber together, the resonance chamber has a plurality of openings, and a diameter of the openings is related to an audio frequency generated by the electronic components in the casing during operation. As a result, the diameter of the openings can be designed according to the audio frequency of noise to be reduced generated by the electronic components. Under such configuration, the electronic device of the invention can consume sound energy via the Helmholtz principle which is that the resonance is generated when the natural frequency of the empty chamber is the same as the frequency of external sound wave. As a result, sound-absorption can be performed on the corresponding audio frequency generated by the corresponding electronic components to achieve the effect of noise reduction.

In order to make the aforementioned features and advantages of the disclosure more comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
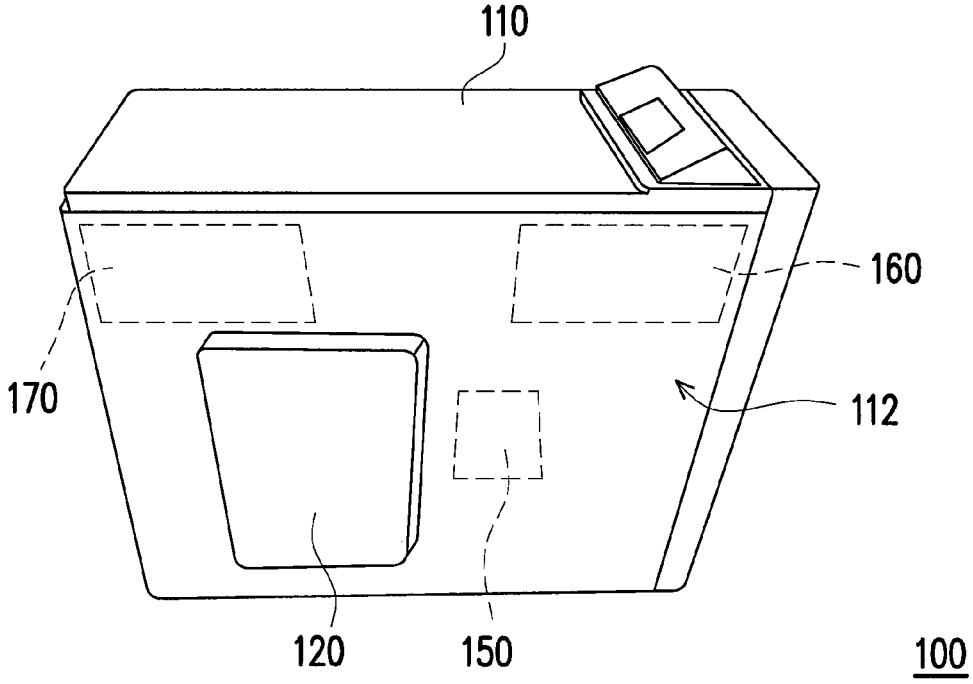
FIG. 1 is a schematic of an electronic device according to an embodiment of the invention.

The foregoing and other technical contents, features, and effects of the invention are intended to be described more comprehensively in each of the following embodiments accompanied with figures. In the following embodiments, terms used to indicate direction such as "up", "down", "front", "back", "left", "right", "inside", and "outside" merely refer to directions in the accompanying figures. Therefore, the directional terms are used to illustrate and are not intended to limit the invention. Moreover, in each of the embodiments below, the same or similar reference numerals are used for the same or similar components.

Figure 2:
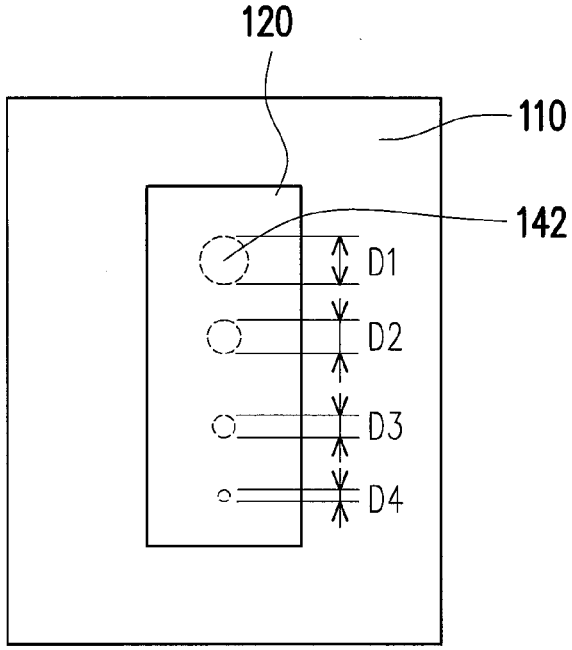
FIG. 2 is a side schematic of an electronic device according to an embodiment of the invention.
Figure 3:
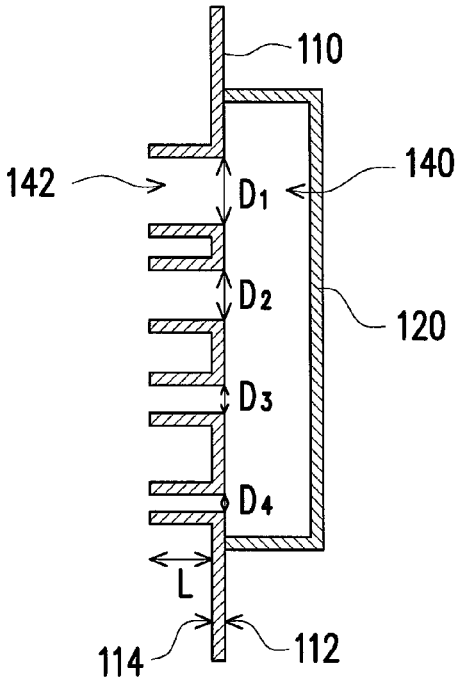
FIG. 3 is a cross-sectional schematic of a portion of the electronic device of FIG. 2.

FIG. 1 is a schematic of an electronic device according to an embodiment of the invention. FIG. 2 is a side schematic of an electronic device according to an embodiment of the invention. FIG. 3 is a cross-sectional schematic of a portion of the electronic device of FIG. 2. Referring to FIG. 1 to FIG. 3, an electronic device 100 of the present embodiment can include a casing 110, a resonance cover 120, and a plurality of electronic components 150, 160, and 170 as shown in FIG. 1, wherein the electronic components 150, 160, and 170 are disposed in a housing space defined by the casing 110. In the present embodiment, the electronic device 100 can be, for instance, a desktop computer, and the electronic components 150, 160, and 170 can include a central processing unit (CPU) fan 150, a hard disk drive (HDD) 160, and a power supply unit (PSU) fan 170. Of course, the present embodiment is only exemplary, and the invention does not limit the type of the electronic components.

Accordingly, the resonance cover 120 can cover the casing 110 as shown in FIG. 3 so as to define a resonance chamber 140 with the casing 110. The resonance chamber 140 can include a plurality of openings 142. Specifically, the casing 110 can have an outer surface 112 and an inner surface 114 opposite to the outer surface 112. The openings 142 can be disposed on the casing 110 as shown in FIG. 3, and the resonance cover 120 is disposed on the outer surface 112 of the casing 110 and covers the openings 142 so as to define the resonance chamber 140 with the casing 110.

In general, the CPU fan 150, the HDD 160, and the PSU fan 170 are the main sources of noise of the electronic device 100 and respectively generate their own audio frequencies during operation. In the present embodiment, the audio frequencies generated by the electronic components 150, 160, and 170 during operation are different from one another. For instance, the audio frequencies generated by the CPU fan 150 and the PSU fan 170 during operation are substantially between 300 Hz and 530 Hz, and the audio frequency generated by the HDD 160 during operation is substantially about 120 Hz. Of course, the present embodiment is only exemplary, and the invention is not limited thereto. In the present embodiment, the diameter of each of the openings 142 is related to the corresponding audio frequencies generated by the corresponding electronic components 150, 160, and 170.

Moreover, the audio frequency range detectable by human ears is usually about 20 Hz to 20000 Hz. More specifically, the human ears are most sensitive to a sound at a frequency of about 1 KHz. Therefore, in the present embodiment, not only can diameters D1, D2, D3, and D4 of the openings 142 be related to the audio frequencies generated by the electronic components 150, 160, and 170, one of the diameters D1, D2, D3, and D4 of the openings 142 can also be related to the audio frequency at 1 KHz. In other words, the diameters D1, D2, D3, and D4 of the openings 142 can respectively be related to the audio frequencies generated by the electronic components 150, 160, and 170 and the audio frequency at 1 KHz. Of course, the present embodiment is only exemplary, and the invention is not limited thereto.

Specifically, the relationship of the diameter of the openings 142 and audio frequency should satisfy the Helmholtz formula:

$$f_0 = \frac{c}{2\pi}\sqrt{\frac{S}{(L+0.8d)V}}$$

More specifically, if the shape of the openings 142 is a circle, then the relationship of a cross-sectional area of the openings 142 and the diameter of the openings 142 should satisfy the relationship of the following formula:

$$S = \frac{d^2\pi}{4}$$

In particular, d represents the diameter of the openings 142, $f_0$ represents the audio frequency generated by each of the electronic components, c represents speed of sound, S represents the cross-section area of the openings, L represents an inner wall thickness of each of the openings 142, and V represents a volume of the resonance chamber 140. In other words, the diameter of the openings 142 is related to the audio frequency generated by the electronic components, the cross-sectional area of the openings 142, the inner wall thickness of each opening, and the volume of the resonance chamber 140. Herein, the inner wall thickness of each of the openings means the thickness of the corresponding inner wall which defines each of the openings.

In the present embodiment, the inner wall thickness L of the openings 142 can, for instance, be preset to be 10 mm, and the volume V of the resonance chamber 140 can be preset to be 64000 $mm^3$ so as to obtain the relationship of the diameter of each of the openings 142 and the corresponding audio frequency, and the diameter of each of the openings 142 can be designed according to the corresponding audio frequency of noise to be reduced. Of course, the numeric values of the present embodiment are only exemplary, and the invention does not limit the numeric values of the inner wall thickness of the openings and the volume of the resonance chamber.

In the present embodiment, the Helmholtz resonance principle is adopted since a resonance phenomenon is occurred when the natural frequency of the empty chamber is the same as the frequency of external sound wave. Therefore, to overcome friction, sound energy is consumed such that the effects of sound-absorption and sound reduction can be achieved. In general, the CPU fan 150, the HDD 160, and the PSU fan 170 are the main sources of noise of the electronic device 100 and respectively generate their own audio frequencies during operation. In the present embodiment, the audio frequencies generated by the electronic components 150, 160, and 170 during the operation are different from one another. For instance, the audio frequencies generated by the CPU fan 150 and the PSU fan 170 during operation are substantially between about 300 Hz and 530 Hz, and the audio frequency generated by the HDD 160 during operation is substantially about 120 Hz. In the present embodiment, the diameter of each of the openings 142 is related to the corresponding audio frequency generated by the corresponding electronic components 150, 160, and 170.

Figure 4:
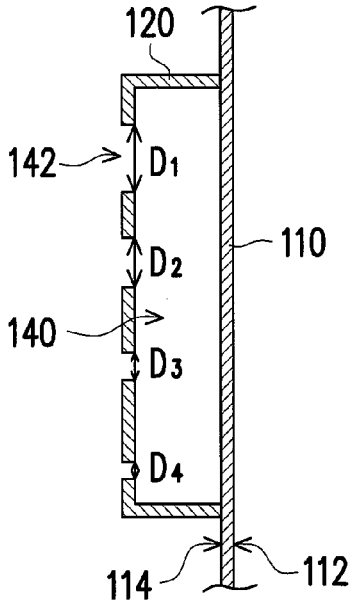
FIG. 4 is a cross-sectional schematic of a portion of an electronic device according to an embodiment of the invention.

FIG. 4 is a cross-sectional schematic of a portion of an electronic device according to an embodiment of the invention. It should be mentioned that, the casing 110 and the resonance cover 120 of the present embodiment are similar to the casing 110 and the resonance cover 120 shown in FIG. 3, and therefore the present embodiment uses the reference numerals of the above embodiments and a portion of the contents thereof, wherein the same reference numerals are used to represent the same or similar components and the same technical content is omitted. The omitted portions are as described in the above embodiments and are not repeated in the present embodiment. Referring to FIG. 3, the differences between the casing 110 and the resonance cover 120 of the present embodiment and the casing 110 and the resonance cover 120 shown in FIG. 3 are described.

Referring to FIG. 4, in the present embodiment, the resonance cover 120 covers the inner surface 114 of the casing 110, and the openings 142 are disposed on the resonance cover 120. Under such disposition, in the present embodiment, the effects of sound-absorption and sound reduction can also be achieved via the Helmholtz resonance principle. Moreover, since the resonance cover 120 covers the inner surface 114 of the casing 110, the resonance chamber 140 defined by both the resonance cover 120 and the casing 110 is located in the casing 110. As a result, the casing 110 of the present embodiment can have a clean appearance.

It should be mentioned that, the casing 110 of FIG. 3 further has an opening extension wall at the edge of each of the openings 142 so as to extend the inner wall thickness L of the openings 142. In the present embodiment, the resonance cover 120 does not have the opening extension wall at the edge of each of the openings 142, and therefore the inner wall thickness L of the openings 142 of the present embodiment is the thickness of the resonance cover 120. Of course, those having ordinary skill in the art should know that the invention does not limit the form and the shape of the openings. The form of the openings can be suitably adjusted according to the inner wall thickness L needed for the actual product.

Based on the above, in the invention, a resonance cover is disposed on the casing such that the resonance cover and the casing define a resonance chamber together, the resonance chamber has a plurality of openings, and a diameter of each of the openings is related to an audio frequency generated by each of the electronic components in the casing during operation. As a result, the diameter of the openings can be designed according to the audio frequency of noise to be reduced generated by the electronic components. Under such configuration, the electronic device of the invention can consume sound energy via the Helmholtz principle which is the resonance generated when the natural frequency of the empty chamber is the same as the frequency of external sound wave. As a result, sound-absorption can be performed on the audio frequency generated by each of the electronic components to achieve the effect of noise reduction.

Although the invention has been described with reference to the above embodiments, it will be apparent to one of the ordinary skill in the art that modifications to the described embodiments may be made without departing from the spirit of the invention. Accordingly, the scope of the invention is defined by the attached claims not by the above detailed descriptions.

What is claimed is:

1. An electronic device, comprising:

a casing;

a resonance cover covering at least a part of the casing so as to define a resonance chamber with the casing, wherein the resonance chamber comprises a plurality of openings; and a plurality of electronic components disposed in the casing and adapted to generate a plurality of audio frequencies, wherein a diameter of each of the openings is related to the corresponding audio frequency generated by the corresponding electronic component, wherein d represents the diameter of each of the openings, $f_0$ represents the audio frequency generated by each of the electronic components, c represents a speed of sound, S represents a cross-sectional area of each of the openings, L represents an inner wall thickness of each of the openings, V represents a volume of the resonance chamber, and a relationship of the diameter of each of the openings and each of the audio frequencies satisfies the following formula:

$$f_0 = \frac{c}{2\pi}\sqrt{\frac{S}{(L+0.8d)V}}.$$

2. The electronic device of claim 1, wherein the openings are disposed on the casing, and the resonance cover is disposed on an outer surface of the casing and covers the openings.

3. The electronic device of claim 1, wherein the resonance cover covers an inner surface of the casing, and the openings are disposed on the resonance cover.

4. The electronic device of claim 1, wherein the diameter of each of the openings is related to the corresponding audio frequency generated by the corresponding electronic component, a cross-sectional area of each of the openings, an inner wall thickness of each of the openings, and a volume of the resonance chamber.

5. The electronic device of claim 1, wherein the inner wall thickness L is substantially 10 mm.

6. The electronic device of claim 1, wherein the volume V of the resonance chamber is substantially 64000 $mm^3$.

7. The electronic device of claim 1, wherein the audio frequencies are different from one another.

8. The electronic device of claim 1, wherein the electronic components comprise a central processing unit (CPU) fan, a hard disk drive (HDD), and a power supply unit (PSU) fan.

9. The electronic device of claim 1, wherein one of the audio frequencies is substantially 1 KHz.

* * * * *